US006876306B2

(12) United States Patent
Nelson et al.

(10) Patent No.: US 6,876,306 B2
(45) Date of Patent: Apr. 5, 2005

(54) INDIVIDUAL MAT INDICATOR

(75) Inventors: Peter Nelson, Nisswa, MN (US); James Leonard, Crosby, MN (US); Joseph Schultz, Brainerd, MN (US)

(73) Assignee: Acrometal Companies, Inc., Brainerd, MN (US)

( * ) Notice: Subject to any disclaimer, the term of this patent is extended or adjusted under 35 U.S.C. 154(b) by 20 days.

(21) Appl. No.: 10/324,584

(22) Filed: Dec. 19, 2002

(65) Prior Publication Data

US 2004/0119596 A1 Jun. 24, 2004

(51) Int. Cl.[7] ..... G08B 21/00
(52) U.S. Cl. ..... 340/666; 200/86.5
(58) Field of Search ..... 340/666, 600; 200/86 R, 86.5; 177/45; 307/116, 119

(56) References Cited

U.S. PATENT DOCUMENTS

| | | | | |
|---|---|---|---|---|
| 4,467,391 A | | 8/1984 | Refoy et al. | 361/179 |
| 4,890,007 A | | 12/1989 | Vu et al. | 307/118 |
| 4,920,241 A | | 4/1990 | Miller | 200/86 R |
| 4,954,673 A | | 9/1990 | Miller | 200/61.43 |
| 5,210,528 A | * | 5/1993 | Schulman et al. | 340/666 |
| 5,510,586 A | | 4/1996 | Hacking | 200/86 R |
| 5,602,428 A | * | 2/1997 | Schultz et al. | 307/119 |
| 5,636,477 A | | 6/1997 | Hulse et al. | 49/264 |
| 6,040,536 A | | 3/2000 | Miller et al. | 200/83 N |
| 6,054,658 A | | 4/2000 | Duhon et al. | 200/86 R |
| 6,420,974 B1 | * | 7/2002 | Baker et al. | 340/666 |
| 6,515,586 B1 | * | 2/2003 | Wymore | 340/541 |

OTHER PUBLICATIONS

Miller Edge Products, Controllers, FS–27, www.milleredge.com/products/fs–27.htm/, Jun. 22, 2001, 2 pages.

Miller Edge Products, Controllers, FSC–37, www.milleredge.com/products/fsc–37.htm, Jun. 22, 2001, 3 pages.

Miller Edge Products, Controllers, FSIS–25–4,www.milleredge.com/products/fsis–25–4.htm, Jun. 22, 2001, pages.

Bircher America Inc.—Products, Safety Mat and Sensing Edge Controllers, www.bircheramerica.com/products/controllers.htm., Jun. 22, 2001, page 1.

Allen–Bradley Safety Products, MatGuard™ Safety Mat Controllers, Jun. 22, 2001, 1 page.

Allen–Bradley Safety Products, MatGuard™ Pressure–Sensitive Safety Mats, Jun. 22, 2001, 1 page.

Recora Switchmat—Fail safe controllers, The Switch is On . . . to Recora Solutions in Fail Save Controllers, www.recora–co.com/failsafe.htm, Jun. 22, 2001, 3 pages.

Recora Switchmat—Operator Counsel, The Switch is On . . . to Recora Solutions in Operator Control, www.recora–co.com/operator.htm, Jun. 22, 2001, 2 pages.

Triad Controls Safety Mat Systems—NSD Controllers, NSD Safety Mat System, www.triadcontrols.com/nsd_controller.html, 3 pages.

Triad Controls Safety Mat Systems—NSD Remote Status Display, NSD Safety Mat System, www.triadcontrols.com/nsd_rsd_information.html, Jun. 22, 2001, 2 pages.

* cited by examiner

*Primary Examiner*—Jeffery Hofsass
*Assistant Examiner*—Jennifer Stone
(74) *Attorney, Agent, or Firm*—Kinney & Lange, P.A.

(57) ABSTRACT

A safety mat monitoring system has individual mat indicators associated with corresponding mat switches. A mat switch is activated by pressure on or malfunction of the mat switch. Once activated, an indicator on a controller is activated and, in turn, the controller activates the corresponding individual mat indicator.

25 Claims, 5 Drawing Sheets

INDIVIDUAL MAT INDICATOR

BACKGROUND OF THE INVENTION

The present invention relates generally to a safety mat monitoring system. In particular, the present invention relates to a safety mat monitoring system which has individual mat indicators on each mat.

In order to protect personnel from coming into contact with dangerous equipment, safety mat systems are installed in danger zones around pieces of equipment. Each safety mat system consists of a controller and one or more mat switches that are placed on the floor around the equipment to sense the presence of a person. The controller monitors the mat switch and is designed to send a stop signal to the dangerous equipment should a person step on a mat switch installed in the danger zone.

It is standard practice for safety mat systems to register a stop/fault condition on the controller box with a single signal device (typically an LED). If a fault condition is registered on the controller, the technical person responsible for the system is notified. The technician then manually troubleshoots the system to isolate the activated mat switch. This inspection is time consuming and costly.

Recent improvements now allow controllers to display the mat switch number corresponding to an active mat switch. Even with this information, the technician still has to locate the layout drawings and identify which mat switch is being identified by the indicator. The technician then troubleshoots and verifies that the mat switch shown on the drawing was truly the mat switch indicated on the controller display.

There is a need for a safety mat system that provides a more efficient method of locating and troubleshooting an active mat. It would also be beneficial to minimize the possibility of misidentifying an active mat.

BRIEF SUMMARY OF THE INVENTION

The present invention is a safety mat switch monitoring system. The system includes a mat switch that has a first indicator associated with the mat switch and a controller which has a second indicator. Activation of or damage to the mat switch activates the first indicator which corresponds with activation of the second indicator. Indicator activation may be provided by pressure on the mat switch or by damage to the mat switch.

DETAILED DESCRIPTION

Figure 1:
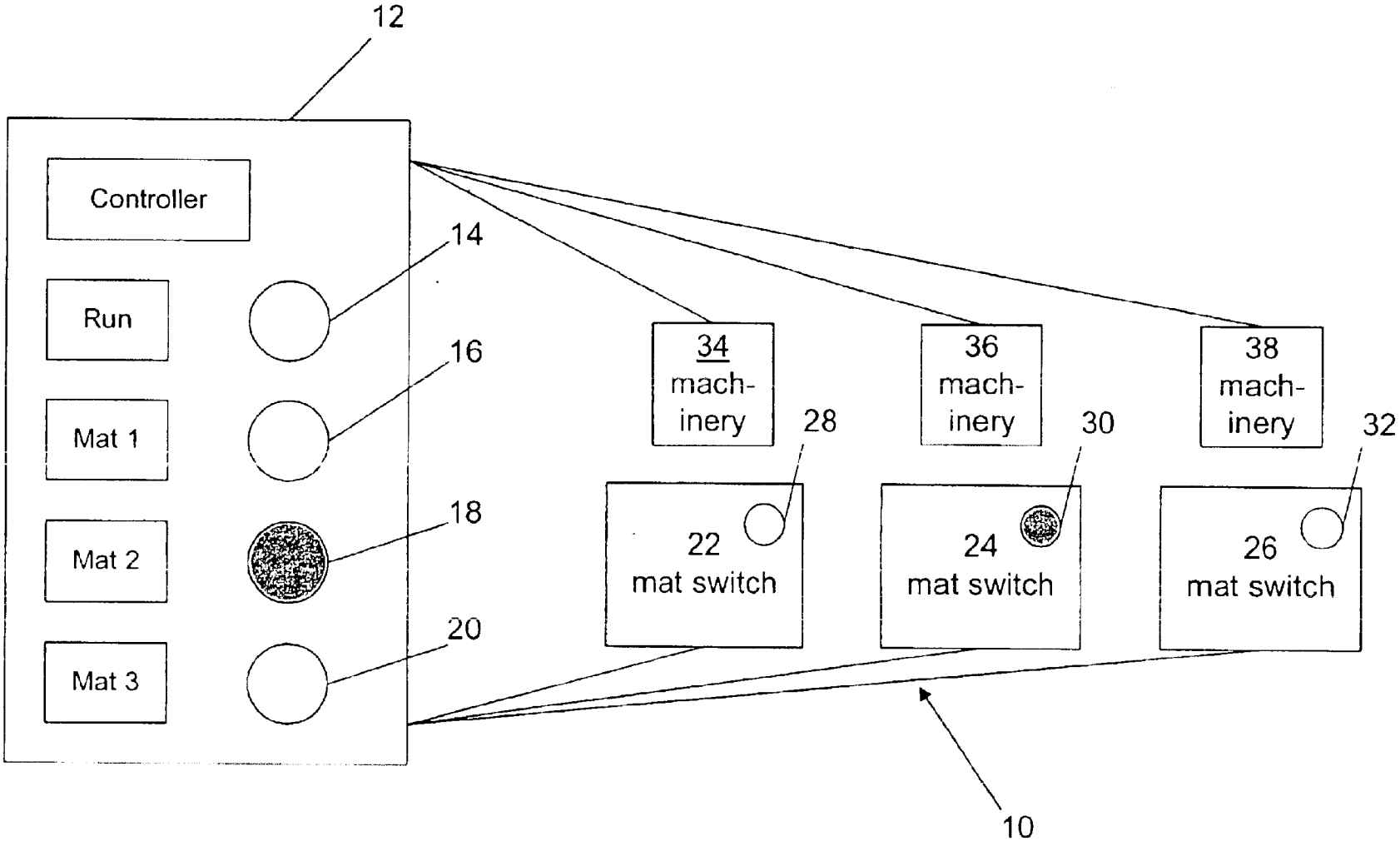
FIG. 1 is a schematic view of the safety mat monitoring system.

FIG. 1 is a schematic illustration of the general layout of the present invention. Safety mat monitoring system 10 includes controller 12 having run indicator 14, mat-1 indicator 16, mat-2 indicator 18 and mat-3 indicator 20; mat switch 22 with indicator 28; mat switch 24 with indicator 30; mat switch 26 with indicator 32; machinery 34; machinery 36; and machinery 38. Controller 12 is connected to mat switch 22, mat switch 24, mat switch 26, machinery 34, machinery 36, and machinery 38. Activation of mat switch 22, mat switch 24, and mat switch 26 renders machinery 34, machinery 36, and machinery 38, respectively, safe via controller 12.

In operation, each indicator is an LED and mat switches 22, 24, and 26 are activated by pressure on, damage to, or malfunction of the mat switch. For example, as shown in FIG. 1, mat switch 24 is activated either by pressure from the presence of a person standing on mat switch 24, or mat switch 24 is damaged or malfunctioning. Upon activation, controller 12 senses that mat switch 24 has been activated and activates mat-2 indicator 18. In turn, controller 12 activates indicator 30 on mat switch 24, which tells the technical personnel that someone is standing on mat switch 24 or that mat switch 24 is malfunctioning. Controller 12 also deactivates or renders safe machinery 36 so that anyone standing on mat switch 24 is safe from machinery 36. Alternatively, controller 12 may not have an indicator, and only indicators at the mat switches alert the technical personnel of mat switch activation.

In another embodiment, multiple mat switches surround a single piece of machinery, because a large zone surrounding the machinery is dangerous while the machinery is running. Activation of any one of the mat switches triggers controller 12 to deactivate or render safe the piece of machinery.

With system 10, the technical personnel no longer have to locate layout drawings to identify which mat switch is being identified by controller 12. The technical personnel only need to identify which mat switch has been activated by literally looking at the indicator on the mat switch. This minimizes the possibility of misidentifying an active mat switch, and the technical personnel are reassured of proper system operation by having an indicator on each mat switch indicating that each mat switch is functioning properly.

Figure 2:
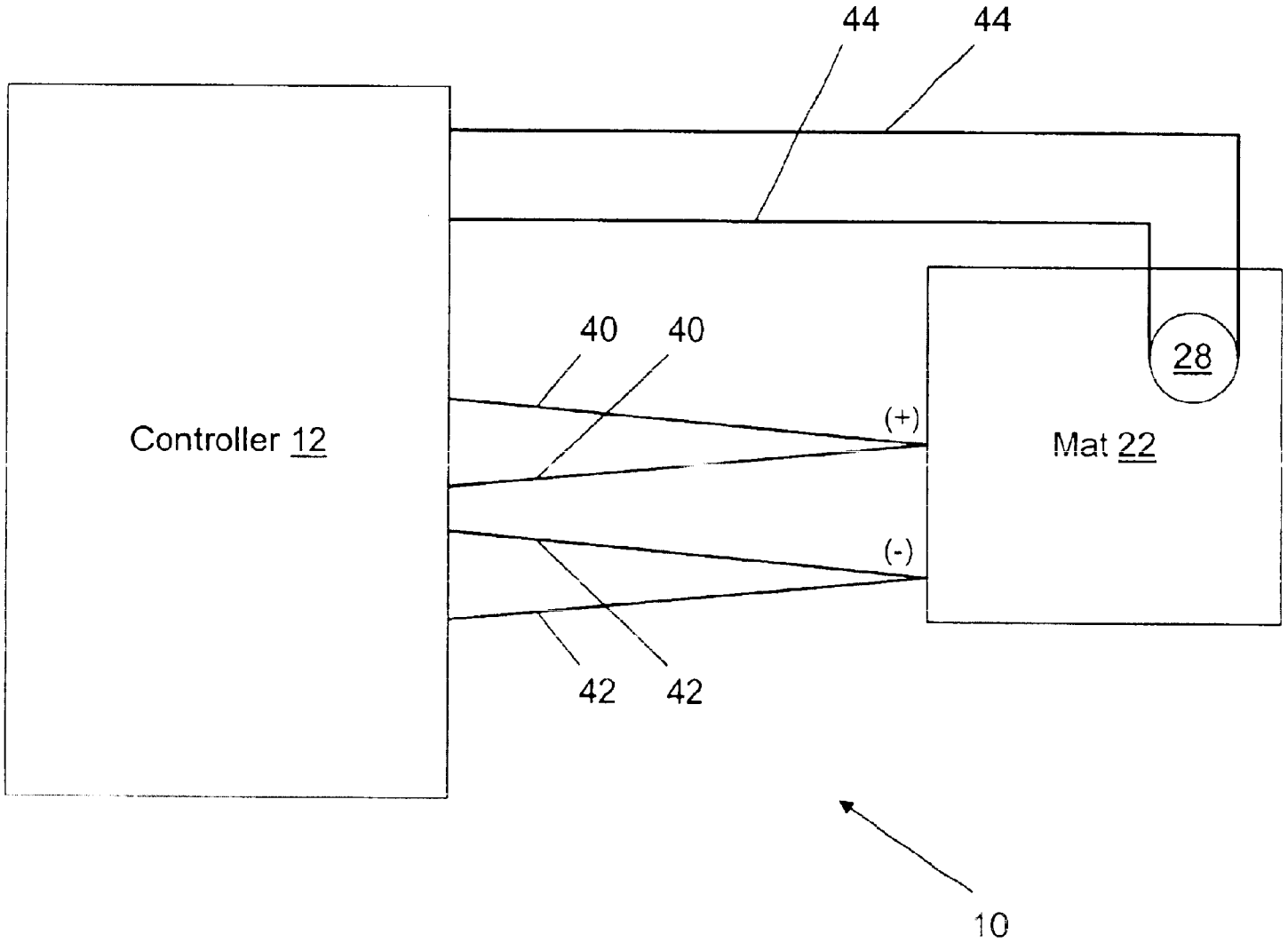
FIG. 2 is a schematic view of the safety mat monitoring system with separate indicator control wires.

FIG. 2 schematically shows the present invention having separate indicator control wires. For simplification, FIGS. 2–5 contain only mat switch 22 connected to controller 12. However, any number of mat switches may be connected to controller 12.

FIG. 2 includes controller 12, mat switch 22 with indicator 28, positive lead wires 40, negative lead wires 42, and control wires 44. Positive lead wires 40 and negative lead wires 42 connect controller 12 to mat switch 22. Control wires 44 connect controller 12 to indicator 28. In this embodiment, when mat switch 22 is activated, the connection through lead wires 40 and 42 alert controller 12 that mat switch 22 has been activated. A signal from controller 12 is transmitted along control wires 44 to indicator 28 to activate indicator 28. Now that indicator 28 is activated, the technical personnel can easily identify the activated mat switch.

Figure 3:
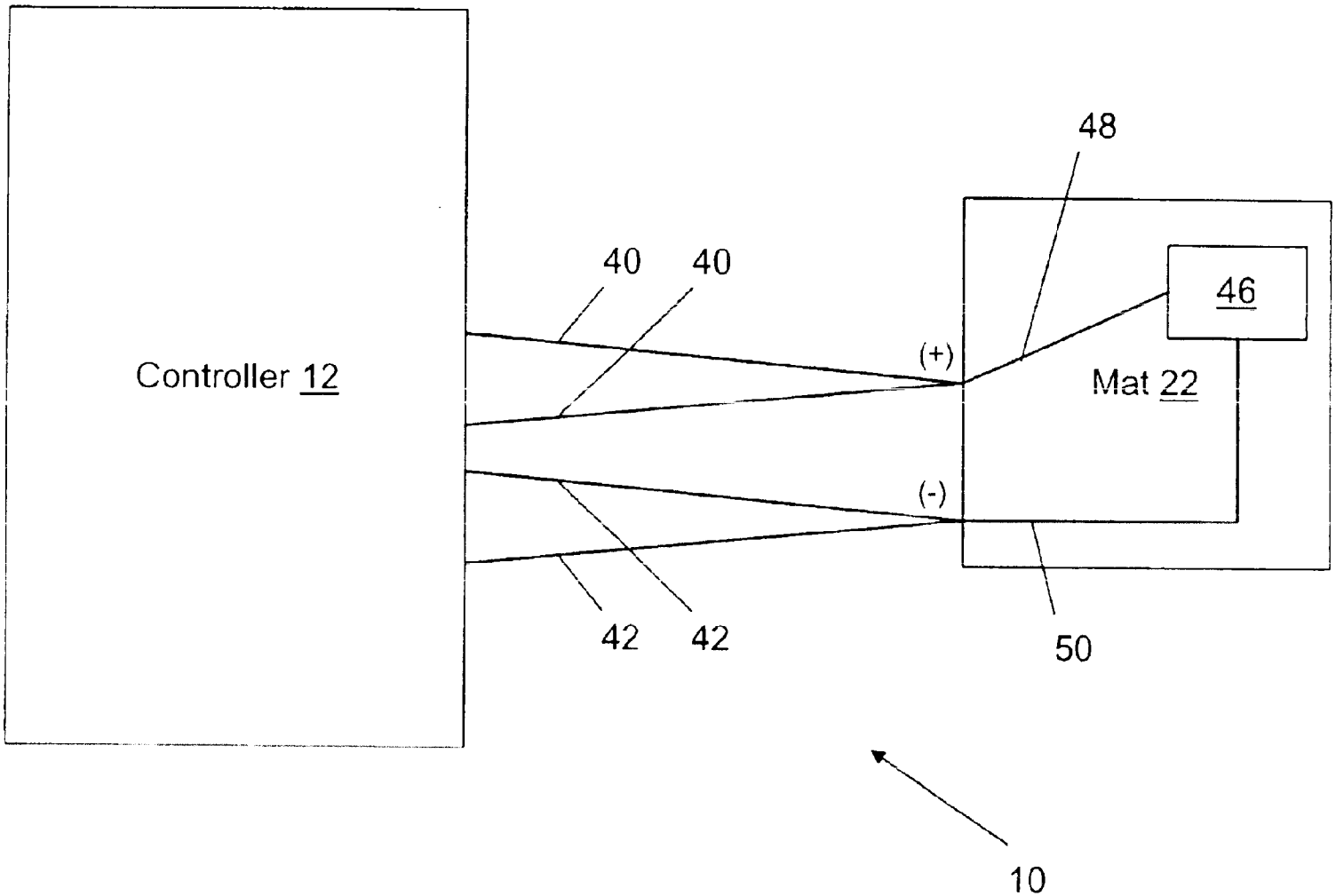
FIG. 3 is a schematic view of the safety mat monitoring system with a reflective LCD indicator.

FIG. 3 schematically shows system 10 having an alternative embodiment wherein the indicator is an LCD. FIG. 3 contains the same basic components with identical reference numbers as FIG. 2 except that line 48 connects positive lead wires 40 to LCD circuit 46 and line 50 connects negative lead wires 42 to LCD circuit 46. In operation, mat status/diagnostic signaling may occur directly at mat switch 22 through LCD circuit 46. LCD circuit 46 is reflective when mat switch 22 is not activated. However, LCD circuit 46 reveals a status message when mat switch 22 is activated due to a voltage drop to LCD circuit 46. LCD circuit 46 may also be an electrochromic indicator that also changes state when mat switch 22 is activated.

Figure 4:
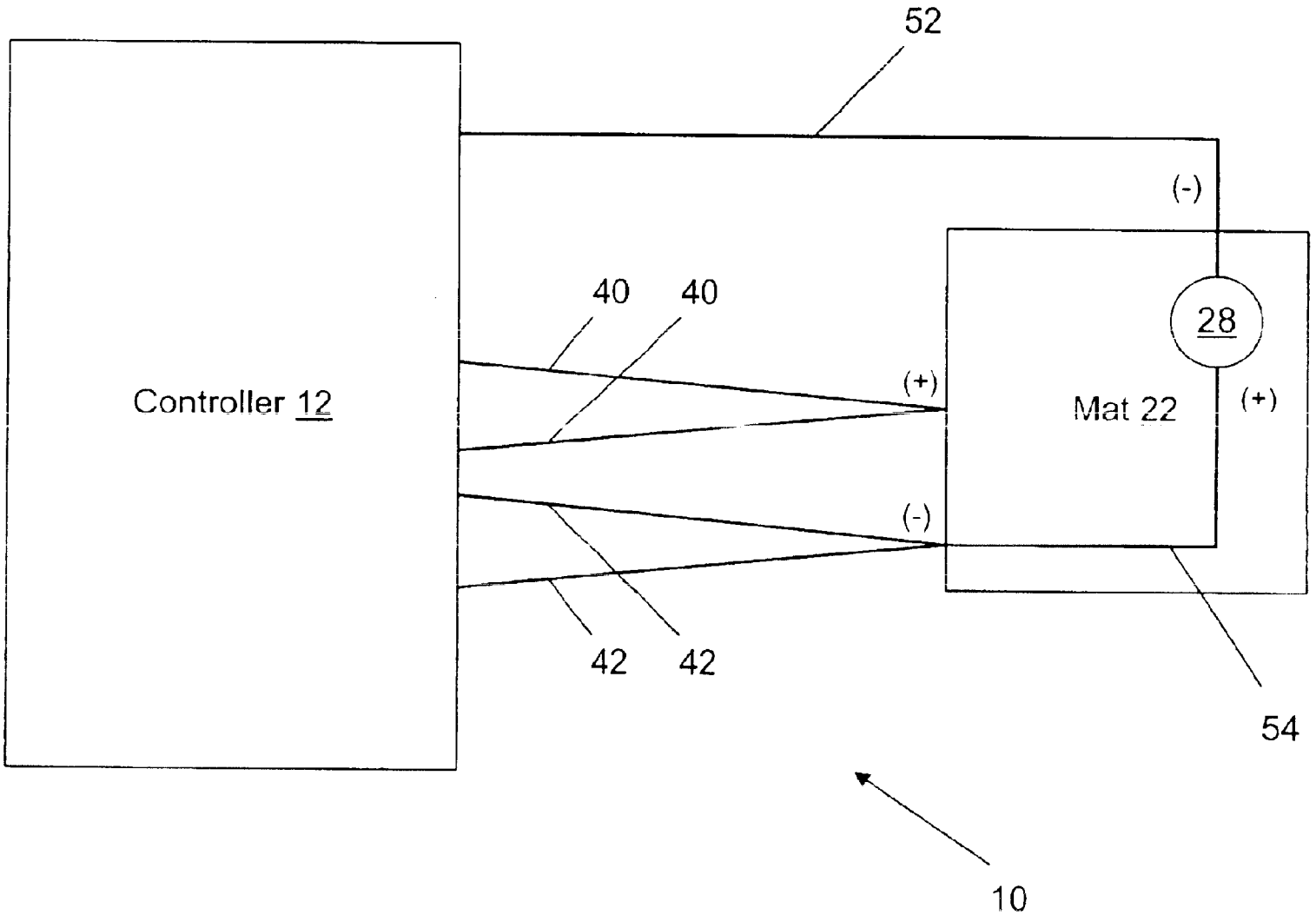
FIG. 4 is a schematic view of the safety mat monitoring system with shared indicator control wires.

FIG. 4 is a schematic view of another embodiment of the present invention having shared indicator control wires. System 10 of FIG. 4 includes the same basic components which are referenced identically as in FIG. 2. However, negative lead wire 52 connects controller 12 to indicator 28. Positive lead wire 54 then connects indicator 28 to negative lead wires 42, which connect controller 12 to mat switch 22. In this embodiment, indicator 28 power, or ground, is shared with controller 12.

Figure 5:
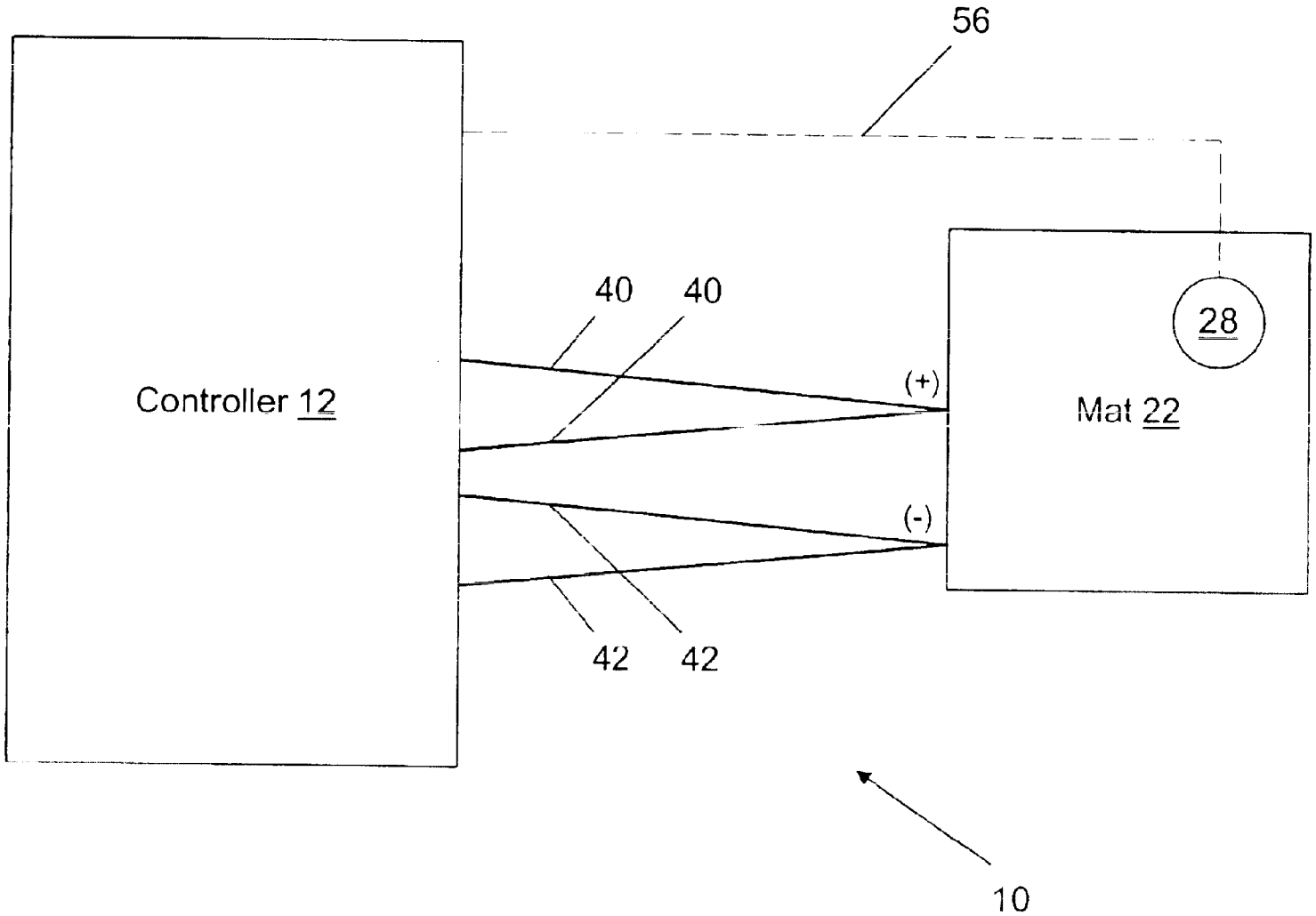
FIG. 5 is a schematic view of the safety mat monitoring system with wireless indicator control.

FIG. 5 shows a schematic view of the present invention having a wireless indicator control. FIG. 5 includes the basic components referenced identically as shown in FIG. 2. FIG. 5 further includes line 56, which represents the wireless connection between controller 12 and indicator 28. In this embodiment, no wires connect controller 12 to indicator 28. System 10 is simplified by having remote wireless control of indicator 28.

With each of the embodiments discussed in the previous Figures, indicator 28 need not be located on mat switch 22 but may be located near mat switch 22. In addition, indicator 28 only needs to be some type of visual light such as an LED, incandescent, or vacuum flourescent light except in the embodiment showing LCD circuit 46. Further, an audible indicator may also be used with or without indicator 28.

Although the present invention has been described with reference to preferred embodiments, workers skilled in the art will recognize that changes may be made in form and detail without departing from the spirit and scope of the invention.

What is claimed is:

1. A mat switch system comprising:

a mat switch having a first indicator; and a controller, having a second indicator, the controller being physically separate from and in communication with the mat switch;

wherein activation of the first indicator corresponds with activation of the second indicator.

2. The system of claim 1 wherein the first indicator is activated by a presence of a person on the mat switch.

3. The system of claim 1 wherein the first indicator is activated when the mat switch malfunctions.

4. The system of claim 1 and further comprising:

a plurality of mat switches having first indicators; and a plurality of second indicators on the controller.

5. The system of claim 1 wherein the mat switch is installed within a dangerous zone.

6. The system of claim 1 wherein the first indicator and the second indicator are visual indicators.

7. The system of claim 1 wherein the first indicator is an audible indicator.

8. The system of claim 1 and further comprising:

an audible indicator on the mat switch; and an audible indicator on the controller.

9. The system of claim 1 wherein status and diagnostic communication between the controller and the mat switch is done with wired control.

10. The system of claim 9 wherein the wired control is implemented with a plurality of wires.

11. The system of claim 9 wherein the continuer and first indicator use shared indicator wired control.

12. The system of claim 1 wherein status and diagnostic communication between the controller and the mat switch is done with wireless control.

13. The system of claim 12 wherein the wireless control is implemented by optical signaling.

14. The system of claim 12 wherein the wireless control is implemented by radio frequency signaling.

15. The system of claim 1 wherein a mat status/diagnostic signal is generated by the first indicator.

16. A monitoring system comprising:

a plurality of first indicators associated with mat switches, each first indicator providing status and diagnostic states of a corresponding mat switch;

a controller that is separate from and in communication with the mat switches and controls activation of the first indicators; and a plurality of second indicators proximate the controller, wherein each first indicator corresponds to one of the second indicators.

17. The system of claim 16 and further comprising:

a plurality of wires connecting the controller to the mat switches.

18. The system of claim 16 and further comprising:

wireless communications between the controller and the mat switches.

19. The system of claim 16 wherein activation of the second indicators activates the corresponding first indicators.

20. The system of claim 19 wherein the second indicators arc activated by pressure on corresponding mat switches.

21. The system of claim 19 wherein the second indicators are activated by malfunctioning corresponding mat switches.

22. A mat switch system comprising:

a mat switch having a first indicator proximate to the mat switch; and a controller separate from the mat switch having a second indicator proximate to the controller, the controller controlling stales of the first indicator and second indicator as a function of a state of the mat switch;

wherein the state of the first indicator corresponds with the state of the second indicator.

23. The system of claim 22 wherein the controller activates the first indicator when pressure is applied to the mat switch.

24. The system of claim 22 wherein the controller activates the first indicator when the mat switch malfunctions.

25. The system of claim 22 wherein the first indicator is in contact with the mat switch.

* * * * *

UNITED STATES PATENT AND TRADEMARK OFFICE

CERTIFICATE OF CORRECTION

PATENT NO. : 6,876,306 B2
DATED : April 5, 2005
INVENTOR(S) : Peter Nelson et al.

It is certified that error appears in the above-identified patent and that said Letters Patent is hereby corrected as shown below:

Column 4,
Line 3, delete “continuer”, insert -- controller --.

Signed and Sealed this

Eighth Day of November, 2005

JON W. DUDAS
*Director of the United States Patent and Trademark Office*